US005472560A

United States Patent [19]

Horng

[11] Patent Number: 5,472,560

[45] Date of Patent: Dec. 5, 1995

[54] TAPE DISPENSER

[75] Inventor: Shun-Jei Horng, Taipei, Taiwan

[73] Assignee: Lin S. H. Horng, Tainan County, Taiwan

[21] Appl. No.: 382,189

[22] Filed: Feb. 1, 1995

[51] Int. Cl.[6] ..... B32B 31/00

[52] U.S. Cl. ..... 156/577; 156/523; 156/579; 156/540

[58] Field of Search ..... 156/523, 527, 156/574, 577, 579, 540, 541

[56] References Cited

U.S. PATENT DOCUMENTS 5,178,717 1/1993 Rodriguez ..... 156/523

5,393,368 2/1995 Stevens ..... 156/577

*Primary Examiner*—James Engel

*Attorney, Agent, or Firm*—Morton J. Rosenberg; David I. Klein

[57] ABSTRACT

A tape dispenser including a casing covered with a cover, a loading wheel mounted on a rear seat inside the casing to hold a double-sided adhesive tape, a cutter blade mounted at one side of a front outlet on the casing for cutting the double-sided adhesive tape, a driven wheel mounted around a shaft inside the casing and turned by the loading wheel through a gear mechanism, and a take-up wheel mounted on the driven wheel and turned to take up the backing paper of the double-sided adhesive tape.

6 Claims, 4 Drawing Sheets

TAPE DISPENSER

BACKGROUND OF THE INVENTION

The present invention relates to tape dispensers, and relates more particularly to a tape dispenser for the application of double-sided adhesive tapes.

Various tape dispensers have been disclosed for the application of adhesive tapes, and have appeared on the market. These tape dispensers are functional for the application of single-side adhesive tapes. However, they are not convenient in use when a double-sided adhesive tape is loaded because they cannot automatically take up the backing paper of the double-sided adhesive tape during the application.

SUMMARY OF THE INVENTION

The present invention has been accomplished to provided a tape dispenser which eliminates the aforesaid drawback. It is one object of the present invention to provide a tape dispenser which is practical in use for the application of double-sided adhesive tapes. It is another object of the present invention to provide a tape dispenser which can automatically take up the backing layer of the double-sided adhesive tape during the application. It is still another object of the present invention to provide a tape dispenser which is simple in structure. It is still another object of the present invention to provide a tape dispenser which is easy to operate.

According to one aspect of the present invention, the tape dispenser comprises a casing covered with a cover, a loading wheel mounted on a rear seat inside the casing to hold a double-sided adhesive tape, a cutter blade mounted at one side of a front outlet on the casing for cutting the double-sided adhesive tape, a driven wheel mounted around a shaft inside the casing and turned by the loading wheel through a gear mechanism, and a take-up wheel mounted on the driven wheel and turned to take up the backing paper of the double-sided adhesive tape. According to another aspect of the present invention, the loading wheel has a plurality of triangular flanges raised from the wheel face for holding down the double-sided adhesive tape. According to another aspect of the present invention, the take-up wheel has a plurality of hooked portions raised from the wheel face and engaging into the wheel face of the driven wheel, therefore the take-up wheel can be turned by the driven wheel but it will slip on the driven wheel when it receives excessive pulling force.

BRIEF DESCRIPTION OF THE DRAWINGS

FIG. 3—1 is an enlarged view taken on part of the loading wheel shown in FIG. 3;

FIG. 3—2 is an enlarged view taken on part of the shaft of the casing shown in FIG. 3;

DETAILED DESCRIPTION OF THE PREFERRED EMBODIMENT

Figure 1:
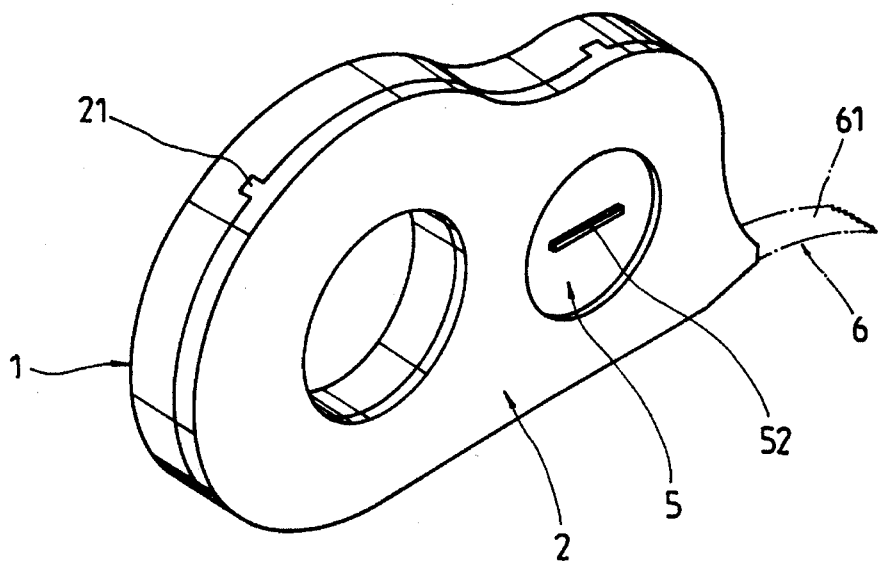
FIG. 1 shows the appearance of a tape dispenser according to the present invention.
Figure 2:
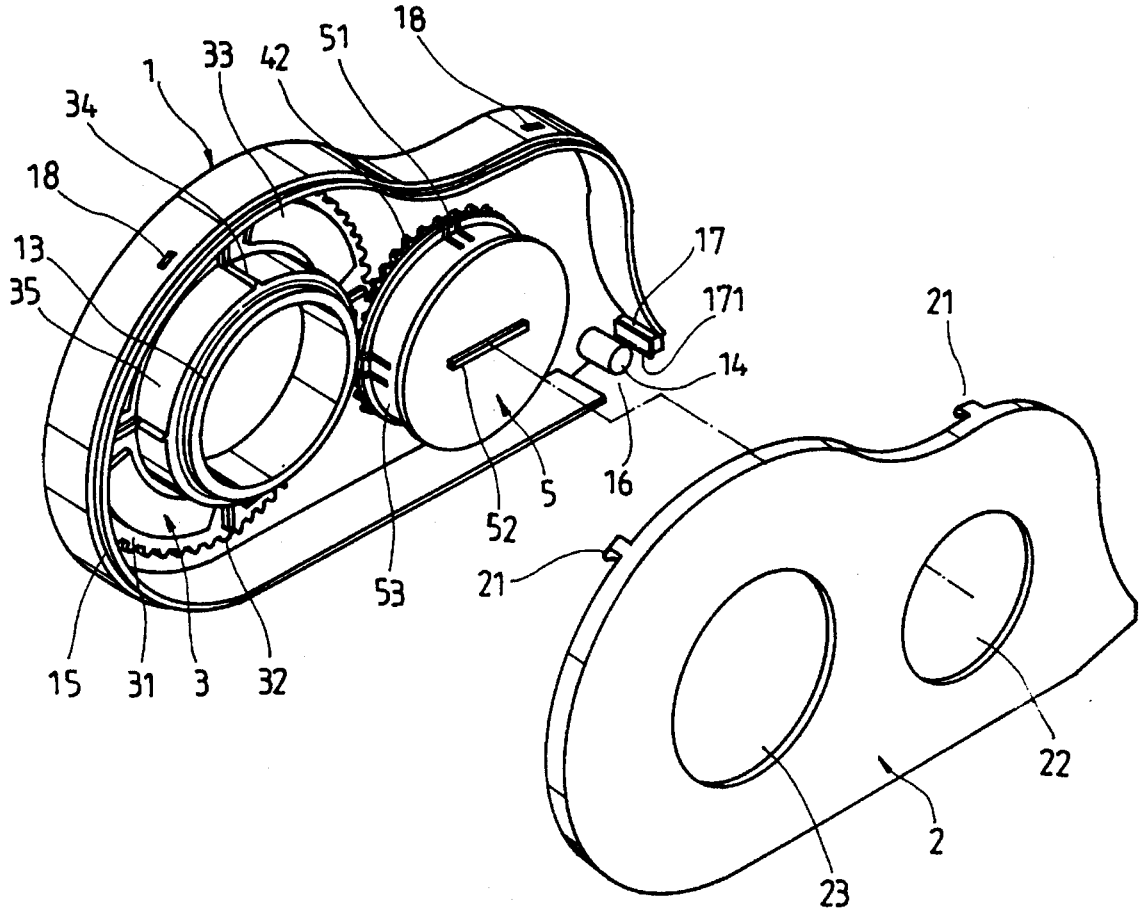
FIG. 2 shows the inside arrangement of the tape dispenser of FIG. 1 when the cover is removed.
Figures 3, 3A, 3B:
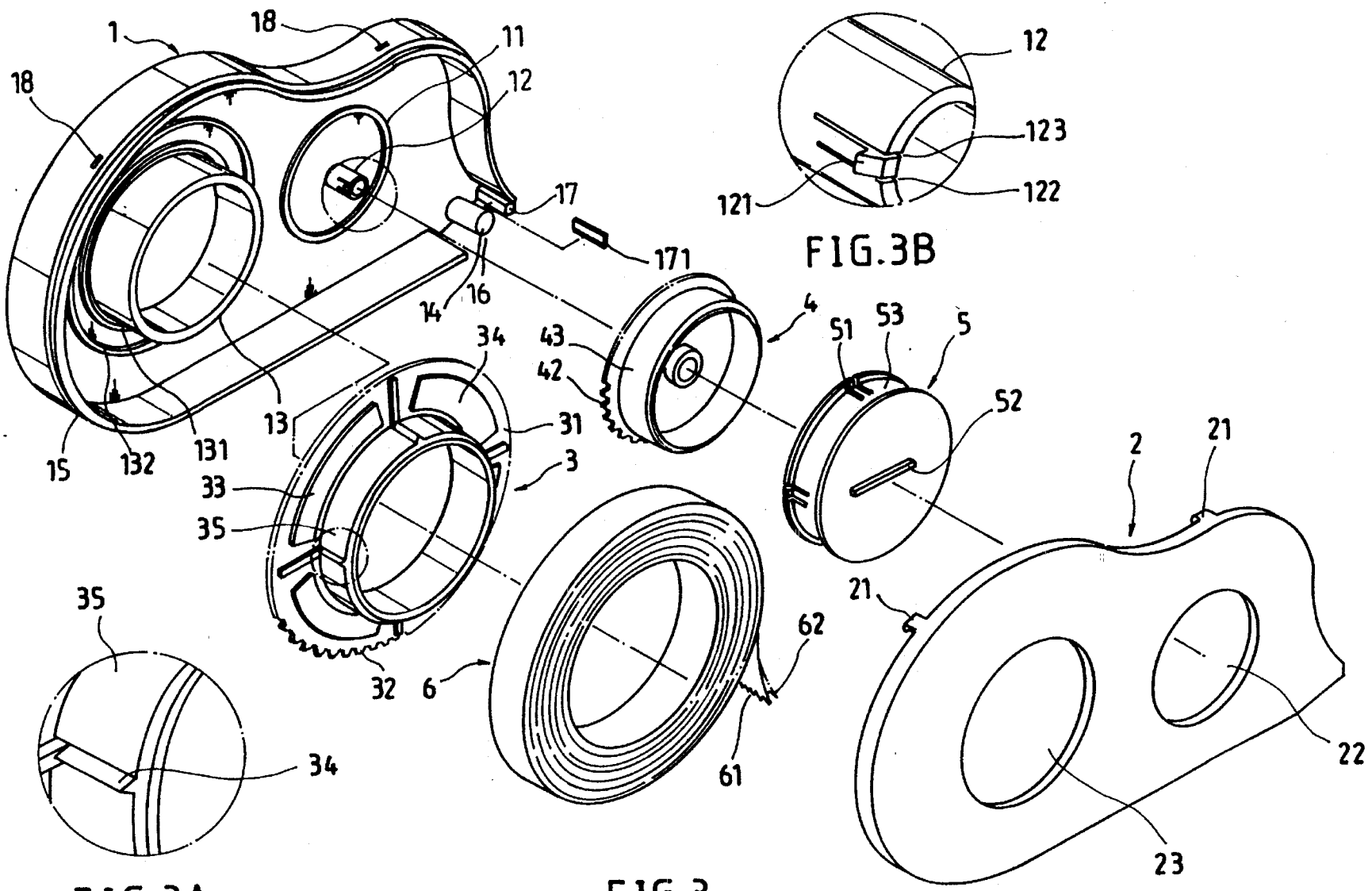
FIG. 3 is an exploded view of the tape dispenser shown in FIG. 1.

Referring to FIGS. 1, 2, 3, 3—1, and 3—2, a tape dispenser in accordance with the present invention is generally comprised of a casing 1, a cover 2, a loading wheel 3, a driven wheel 4, a take-up wheel 5, and a double-sided adhesive tape 6. The casing 1 comprises a front seat 11, which receives the driven wheel 4, a shaft 12 raised from the center of the front seat 11, which supports the driven wheel 4, a rear seat 13, which receives the loading wheel 3, a front outlet 16, a guide rod 14 disposed adjacent to the front outlet 16, a cutter holder 17 disposed by one side of the front outlet 16 to hold a cutter blade 171, a mounting groove 15 around the border, and a plurality of mounting holes 18 spaced along the mounting groove 15. The shaft 12 comprises a plurality of longitudinal splits 121 and 122 and a plurality of hooked portions 123 respectively spaced by the longitudinal splits 121 and 122 (see FIG. 3—2). The rear seat 13 comprises a first annular flange 131 and a second annular flange 132 surrounding the first annular flange 131. When the loading wheel 3 is mounted on the rear seat 13 to hold the double-sided adhesive tape 6, it is supported on the first annular flange 131 and the second annular flange 132 and spaced from the inside surface of the casing 1, and therefore the friction force between the casing 1 and the loading wheel 3 is minimized. The driven wheel 4 has an axle housing 41 at the center, into which the shaft 12 is inserted, and a gear 42 disposed at one side of the wheel face 43. When the driven wheel 4 is mounted around the shaft 12, the hooked portions 123 stop outside the axle housing 41, and therefore the driven wheel 4 does not disconnect from the shaft 12. The take-up wheel 5 is mounted on the driven wheel 4, having a plurality of hooked portions 51 projected from the wheel face 53 and engaging into the wheel face 43 of the driven wheel 4, and a finger rod 52 at one side extended out of the cover 2 for turning by fingers to take up the backing paper 62 of the double-sided adhesive tape 6. Because the hooked portions 51 engage into the wheel face 43 of the driven wheel 4, the take-up wheel 5 can be turned by the driven wheel 4 but it will slip on the driven wheel when it bears excessive pulling force. The loading wheel 3 comprises a base 31 supported on the first annular flange 131 and the second annular flange 132, a gear 32 integrally formed on the base 31 around the border and meshed with the gear 42 of the driven wheel 4, a plurality of raised portions 33 raised from the base 31, which stop one side of the double-sided adhesive tape 6, a wheel face 35, which holds the double-sided adhesive tape 6, and a plurality of triangular flanges 34 equiangularly raised from the wheel face 35, which hold down the adhesive tape 6 on the wheel face 35 (see FIG. 3—1). The cover 2 is mounted around the mounting groove 15 on the casing 1, having a plurality of retainer rods 21 respectively fitted into the mounting holes 18 on the casing 1, a first round hole 22, through which the finger rod 52 of the take-up wheel 5 extends out of the cover 2, and a second round hole 23, which receives the loading-wheel 3.

Figure 4:
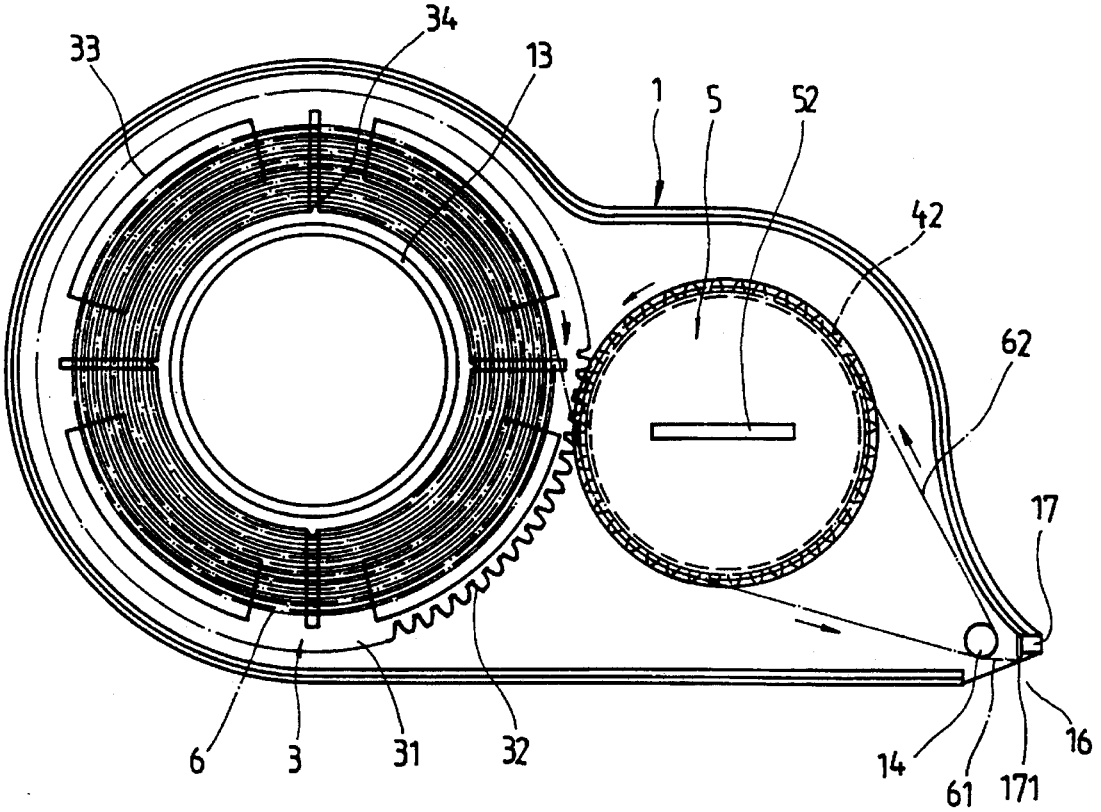
FIG. 4 is a side view in section of the tape dispenser shown in FIG. 1, showing the moving direction of the backing paper of the double-sided adhesive tape.
Figure 5:
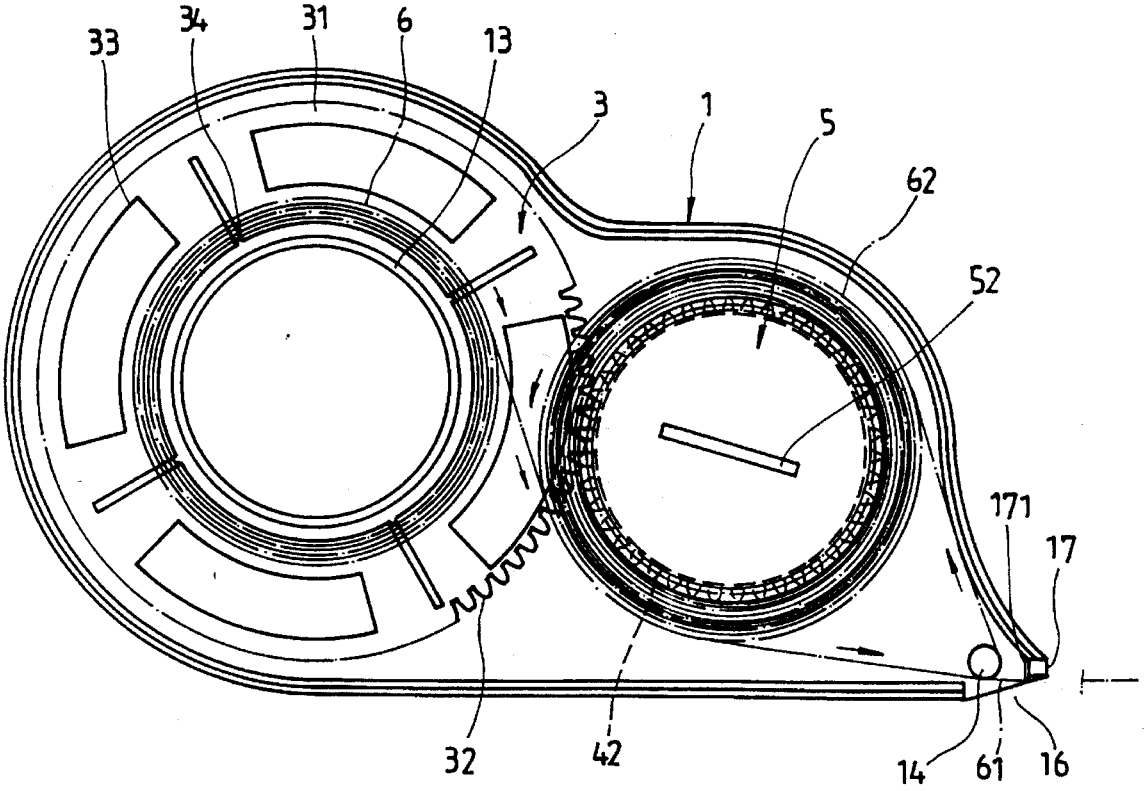
FIG. 5 is similar to FIG. 4 but showing the take-up wheel rotated and the backing paper of the double-sided adhesive tape taken up by the take-up wheel.
Figure 6:
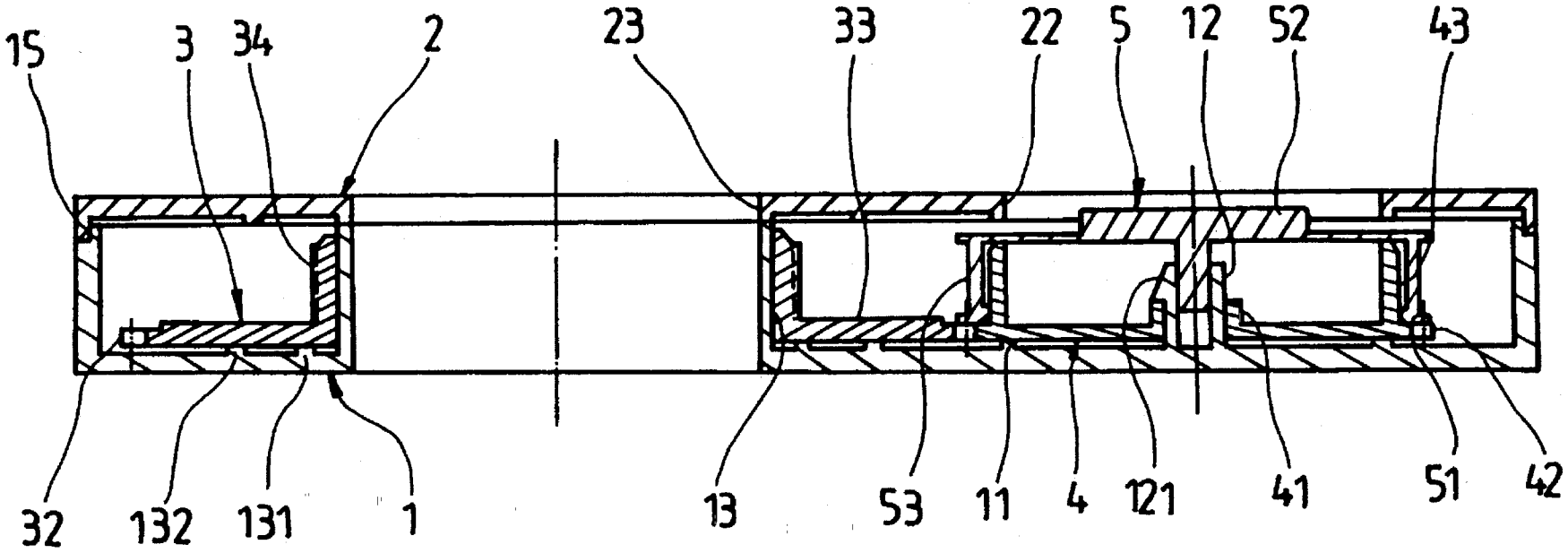
FIG. 6 is a longitudinal view in section of the tape dispenser shown in FIG. 1.

Referring to FIGS. 4, 5, and 6, the double-sided adhesive tape 6 comprises a double-sided adhesive layer 61 and a backing paper 62 covered on one side of the double-sided adhesive layer 61. When the double-sided adhesive tape 6 is loaded on the wheel face 35 of the loading wheel 3, the lead end of the backing paper 62 is fastened to the wheel face 53 of the take-up wheel 5, and the lead end of the double-sided adhesive layer 61 is moved over the guide rod 14 and then extended out of the casing 1 through the front outlet 16. When the lead end of the double-sided adhesive layer 61 is pulled outwards, the loading wheel 3 is driven to turn the driven wheel 4, causing it to take up the backing paper 62. By forcing the double-sided adhesive layer 61 of the double-sided adhesive tape 6 against the cutting edge of the cutter blade 171, the double-sided adhesive layer 62 cut to desired length.

While only one embodiment of the present invention has been shown and described, it will be understood that various modifications and changes could be made without departing from the spirit and scope of the invention.

What is claimed is:

1. A tape dispenser comprising:

a casing having a front seat, a shaft raised from the said front seat, a rear seat, a front outlet, a guide rod adjacent to said front outlet, a cutter holder disposed by one side of said front outlet, a cutter blade fastened to said cutter holder, a mounting groove, around the border, and a plurality of mounting holes spaced along said mounting groove;

a cover mounted on said mounting groove and covered over said casing, said cover having a plurality of retainer rods respectively fitted into said mounting holes on said casing, and at least one opening;

a loading wheel mounted on said rear seat to hold a double-sided adhesive tape;

a driven wheel mounted on said front seat and turned on said shaft by said loading wheel; and a take-up wheel mounted on said driven wheel for taking up the backing paper of the double-sided adhesive tape being loaded on said loading wheel, said take-up wheel having a finger rod extended out of said cover through said at least one opening for turning said take-up wheel by fingers.

2. The tape dispenser of claim 1 wherein said shaft of said casing comprises a plurality of longitudinal splits and a plurality of hooked portions spaced by said longitudinal splits and stopped outside said driven wheel.

3. The tape dispenser of claim 1 wherein said rear seat comprises a first annular flange and a second annular flange surrounding said first annular flange to support said loading wheel above said casing.

4. The tape dispenser of claim 1 wherein said loading wheel comprises a gear at one side, said driven wheel comprises a gear at one side meshed the gear on said loading wheel.

5. The tape dispenser of claim 1 wherein said loading wheel comprises a wheel face, which supports said double-sided adhesive tape, and a plurality of triangular flanges equiangularly raised from the wheel face of said loading wheel to hold down said double-sided adhesive tape on said loading wheel.

6. The tape dispenser of claim 1 wherein said take-up wheel comprises a wheel face and a plurality of hooked portions engaging the periphery of said driven wheel.

* * * * *